United States Patent [19]

Gross et al.

[11] 4,265,781

[45] May 5, 1981

[54] LOW DENSITY SPRAY DRIED PRODUCT

[75] Inventors: William S. Gross, West Caldwell; Edward J. Gibbons, Fanwood; Joseph B. Wraga, Secaucas, all of N.J.

[73] Assignee: Colgate-Palmolive Company, New York, N.Y.

[21] Appl. No.: 80,836

[22] Filed: Oct. 1, 1979

Related U.S. Application Data

[63] Continuation-in-part of Ser. No. 944,380, Sep. 21, 1978, abandoned, which is a continuation of Ser. No. 844,860, Oct. 25, 1977, abandoned, which is a continuation of Ser. No. 614,461, Sep. 18, 1975, abandoned.

[51] Int. Cl.[3] ..... C11D 17/06; C11D 17/00

[52] U.S. Cl. ..... 252/174; 159/4 R; 159/47 R; 159/48 R; 159/DIG. 14; 264/13; 239/601

[58] Field of Search ..... 252/174, 134, DIG. 16, 252/90; 159/DIG. 14, 4 R, 4 F, 4 S, 4 ST, 47 R, 48 R; 428/402; 264/13, 14; 239/601

*Primary Examiner*—Harris A. Pitlick
*Attorney, Agent, or Firm*—Herbert S. Sylvester; Murray M. Grill; John A. Stemwedel

[57] ABSTRACT

A low density spray dried product such as a detergent having a central body in the form of an irregular-shaped bead with a plurality of nodules or arms extending in a cruciform manner outwardly thereof.

5 Claims, 4 Drawing Figures

FIG. 1
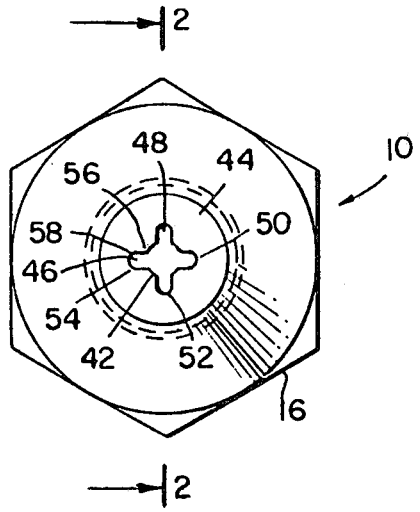
FIG. 2
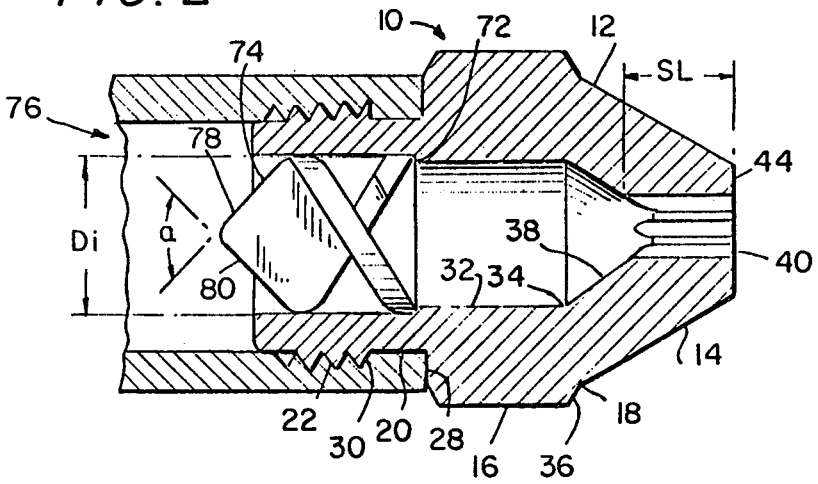
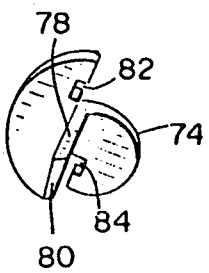
FIG. 4
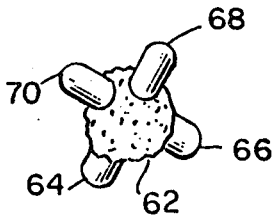
FIG. 3

LOW DENSITY SPRAY DRIED PRODUCT

REFERENCE TO RELATED APPLICATION

This is a continuation-in-part of application Ser. No. 944,380, filed Sept. 21, 1978, now abandoned for "Apparatus and Process for Producing a Low Density Spray Dried Product," which was a continuation of application Ser. No. 844,860, filed Oct. 25, 1977, now abandoned for "Apparatus and Process for Producing a Low Density Spray Dried Product," which was a continuation of application Ser. No. 614,461, filed Sept. 18, 1975, now abandoned for "Apparatus and Process for Producing a Low Density Spray Dried Product."

BACKGROUND OF THE INVENTION

1. Field of the Invention

The present invention relates in general to the field of spray dried products and more particularly to a low density spray dried product.

2. Description of the Prior Art

Spray dried products, such as detergent powders, are conventionally manufactured by spraying an intermediate form of the product, such as a solution or liquid mixture into air, which may be heated to improve its moisture absorbing capacity, and then collecting the product which has the form of a dry powder. In conventional spray drying apparatus the spray nozzles have orifices which are circular in cross-section, resulting in a final low density product composed of pellets or beads which are generally spherical in shape. This spherical shape results in a product which has a relatively low bulk density and a relatively low surface area.

SUMMARY OF THE INVENTION

The present invention overcomes the limitations of the prior art by providing an improved low density spray dried product. This apparatus for producing the present invention comprises a spray nozzle having a central aperture or orifice and radiating outwardly from the central orifice a plurality of slot-like apertures arranged, as in the case of four slot-like apertures in a generally cruciform shaped configuration. During the spraying process, the intermediate product fills both the central aperture and the slot-like apertures producing a final product comprising beads which have a generally irregular central portion with nodules or protrusions formed thereon. Generally, the "beads" are quite irregular in shape rather than spherical, the nodules protruding from the surface thereof enhancing the irregularity. Thus, the term "beads" as used herein is to be interpreted having reference to the foregoing remarks. The nodules or protrusions are formed by material which flows through the slot-like apertures. Beads formed according to the process and using the apparatus according to the present invention have a relatively large surface area and a product comprising these beads has a lower bulk density than a conventional spray dried product which is composed of generally spherical beads. The beads produced in accordance with the present invention advantageously have an irregularly-shaped central portion which produces a greater total void volume (air space) thereby yielding a lower apparent bulk density. This is in contrast with the more compact beads produced according to the prior art nozzle apparatus having spherical comparatively regularly shaped central portions having lower void volume and thus greater apparent bulk density.

In the case of a detergent, the increased surface area of the beads manufactured according to the present invention results in an improved ability of the detergent to mix with water during the cleaning process.

An object of the present invention is to produce a low density spray dried product comprising beads having a generally irregularly shaped central portion with nodules formed thereon.

These, together with various ancillary objects of the present invention are obtained by this low density spray dried product, a preferred embodiment of which is shown in the accompanying drawing, by way of example only, wherein:

BRIEF DESCRIPTION OF THE DRAWING

FIG. 1 is a top view of a nozzle used to produce a low density spray dried product according to the present invention;

FIG. 2 is a sectional view taken along the plane of line 2—2 in FIG. 1;

FIG. 3 is an enlarged perspective view of a spray dried product according to the present invention; and, FIG. 4 is a front elevational view of an internal vane as viewed along directional arrow 76 in FIG. 2.

DETAILED DESCRIPTION OF THE DRAWING

With continuing reference to the accompanying drawing, wherein like reference numerals designate similar parts throughout the various views, reference numeral 10 is used to generally designate a nozzle for the manufacture of a low density spray dried product.

The nozzle 10 includes a body portion 12 having a generally conical surface 14, a hexagonal portion 16 disposed adjacent to the larger diameter 18 of the conical surface 14 and a portion 20 having a reduced diameter. The portion 20 of the nozzle 10 having a reduced diameter has an externally threaded portion 22 to facilitate attachment of the nozzle 10 to conventional spray drying equipment. The lower end 24 of the nozzle 10 has a first circular bore 26 extending upward into the portion 20 of the nozzle 10 having a reduced diameter. The first circular bore 26 has an upper end 28 which is generally in line with the upper end 30 of the externally threaded portion 22. A second circular bore 32 leads upward from the upper end 28 of the first circular bore 26 to an upper end 34 which is generally in line with the upper end 36 of the hexigonal portion 16. The second cylindrical bore 32 has a diameter which is slightly smaller than the first cylindrical bore 26 and leads to an inwardly tapered bore 38 which extends upward in the body portion 12 and leads to a spray orifice 40 which will be presently described in detail. The reduced diameter of second cylindrical bore 32 is defined by edge 72 which provides an abutting and supporting surface for internal vane 74 which is positioned within first circular bore 26. Internal vane 74 may be of any convenient design as is known in the art. One such design is illustrated in FIG. 4 and represents internal vane 74 as viewed along directional arrow 76 in FIG. 2. Internal vane 74 imparts a swirling motion to the liquid material being fed to slot openings 46, 48, 50, and 52. Internal vane 74 is adapted to fit loosely within first circular bore 26 and is maintained in place during operation by the pressure of the liquid feed which urges internal vane 74 against edge 72. Surfaces 78 and 80 of internal vane 74, illustrated as being substantially planar, can project slightly outwardly of first cylindrical bore 26 as illustrated in FIG. 2. The angle "a" described by intersection of surfaces 78 and 80 (FIG. 2) may vary within relatively wide limits e.g., from about 100°-125° with FIG. 2 illustrating this angle as being 108°. However, it should be understood that the internal vane design illustrated in FIGS. 2 and 4 is given by way of example only and accordingly, other designs of diverse types are contemplated. In any event, the viscous liquid feed is "swirled" through apertures 82 and 84 which communicate with the internal portions of nozzle 10. It will be understood that the physical relationships between the aforedescribed apparatus components may be varied, such as bore diameter, included angle of tapered bore 38 and the like. By way of example only, a particularly effective nozzle device is obtained when tapered bore 38 has an included angle of from about 65° to 75° with a preferred value being 70°, initial diameter of first circular bore 26 (Di in FIG. 2) being from about 0.252 to 0.254 inch and the diameter of second circular bore 32 being from about 0.238 to 0.240 inch.

The spray orifice 40 has a central circular bore 42 which is in line with the central axis of the inwardly tapered bore 38 and leads from the inwardly tapered bore 38 to the top surface 44 of the nozzle 10. Radiating outwardly from the central circular bore 42 are a suitable number of slot openings, as for example, from 1 to 8 slot openings. It will be understood that the number of slot openings, four such openings being illustrated in FIG. 1, may vary from 1 to 8 or more, such considerations being largely a matter of design. In general, however, and to insure the obtention of optimum results, it is recommended that from about 3 to 6 slot openings be employed while four slot openings appears optimum. Four slot openings 46, 48, 50, and 52 are illustrated each of which extends from the inwardly tapered bore 38 to the top surface 44 of the nozzle 10. Each of the slots 46, 48, 50, and 52 is defined by a pair of spaced apart generally parallel walls, two of which are designated, by way of example, as the walls 54 and 56 of the slot 46 and the slots 46, 48, 50, and 52 are each further defined by a semi-circular wall one of which is designated, by way of example, as the wall 58 which joins the walls 54 and 56. Each of the slots 46, 48, 50, and 52 are cut to a suitable depth or an equal depth and the slots 46 and 48, 48 and 50, 50 and 52, and 52 and 46 are disposed at right angles respectively, with the slots 46, 48, 50, and 52 thus forming a cross-like or cruciform configuration when viewed from the top of the nozzle 10 as in FIG. 1. One example of a preferred relationship between the diameter of the central circular bore 42 and the width of the slots 46, 48, 50, and 52 may be seen in the following dimension which are cited by way of example only: diameter of central bore=0.465 inches; width of slot=0.160 inches. As discussed previously, the defined diameter and taper angle values may be varied between relatively wide limits. However, it is essential, in any event, that the relationship between the length of the slot apertures, indicated at SL in FIG. 2, and the diameter of first circular bore 26, indicated at Di in FIG. 2 be maintained within a prescribed range. It has been determined in this regard that the length of the slot openings (SL) should be at least about 50% of the diameter of first circular bore 26 (Di), with a range of from about 50 to 85% being preferred. Thus, it is found that slot length below the values specified lead to a product having inferior density characteristics.

The inwardly tapered bore 38 and the conical outer surface 14 of the nozzle 10 provides a generally uniform wall thickness with the absence of points of stress concentration, which enables the nozzle 10 to withstand the generally high pressures required by the spray-drying proccess.

The low density spray dried product according to the present invention is produced by the steps of spraying an intermediate form of the product, such as a liquid mixture of the product, through a nozzle shown in FIG. 1, into a chamber containing air which may be heated to increase its moisture absorbing capacity and then collecting the spray dried product using one of several known collecting methods.

The spray dried product produced according to the above process using the nozzle 10 of FIG. 1 comprises a multiplicity of individual beads. Each of these individual beads 60 has a generally irregular central portion 62, as shown in FIG. 3, which is formed by the central circular bore 42 and from one to four protuberances or nodules 64, 66, 68, and 70 which are formed by at least one of the slots 46, 48, 50, and 52. Since the final product comprises a multiplicity of randomly oriented beads, each similar to the beads 60, the various protuberances on the various beads 60 come into contact and the product has a lower bulk density than a conventional product which comprises a multiplicity of spherical beads. In the case of a spray dried detergent, the products manufactured using the apparatus and process according to the present invention, benefits from the increased surface area of the beads resulting in increased effectivity and efficiency of the product during use since the time and the amount of mechanical agitation required for the product to enter into solution are both greatly reduced.

The use of the nozzle 10 gives a lower than normal density product. Tests were undertaken on two different detergents both using a nozzle according to FIG. 1 and a conventional spray nozzle at different pressures. In all conditions using the nozzle according to FIG. 1, the results achieved a lower density product. Tests were made using a 0.1% Polyox Resin WSRN-3000 and 0.5% Polyox Resin WSRN-3000. The following is a summary of the results using different pressures on 0.1% Polyox resin:

| Run | Average Cup Weight | Range of Cup Weight | Type of Nozzle Used |
|---|---|---|---|
| DCP-16-384 | 87.4 | 73-101 | Control |
| (A) | 75.9 | 66-91 | FIG. 1 Nozzle |
| | 101.1 | 84-109 | Control |
| DCP-16-407 | 107.8 | 98-115 | Control |
| (6P) (B) | 89.3 | 85-95 | FIG. 1 Nozzle |
| DCP-16-408 | 105.7 | 97-110 | Control |
| (6P) (C) | 92.1 | 86-98 | FIG. 1 Nozzle |
| DCP-16-409 | 82.9 | 70-96 | Control |
| (D) | 70.9 | 66-79 | FIG. 1 Nozzle |
| DCP-16-385 | 72.8 | 64-83 | FIG. 1 Nozzle |
| (E) | 91.7 | 86-97 | Control |
| DCP-16-405 | 71.2 | 64-80 | Control |
| (F) | 62.0 | 51-72 | FIG. 1 Nozzle |
| | 67.6 | 51-78 | Control |
| DCP-16-425 | 88.3 | 84-96 | Control |
| (G) | 64.7 | 47-81 | FIG. 1 Nozzle |
| | 89.1 | 77-96 | Control |

A latitude of modification, substitution and change is intended in the foregoing disclosure, and in some instances, some features of the present invention may be employed without a corresponding use of other features.

What is claimed is:

1. A low density spray dried product comprising a body in the form of an irregular shaped bead having a plurality of spaced nodules protruding therefrom.

2. A product according to claim 1, wherein the said nodules extend in a cruciform arrangement with respect to said bead.

3. A product according to claim 2, wherein said nodules have a length of at least 50% the diameter of said bead.

4. A product according to claim 2, wherein said nodules have a length of between 50% to 85% of the diameter of said bead.

5. A product according to claim 4, wherein said nodules have rounded ends.

* * * * *